United States Patent [19]

Felter

[11] Patent Number: 4,619,620

[45] Date of Patent: Oct. 28, 1986

[54] WATER SPORTS APPARATUS

[76] Inventor: Mark R. Felter, 2626 Indian Hill Rd., Cedar Rapids, Iowa 52403

[21] Appl. No.: 713,696

[22] Filed: Mar. 19, 1985

[51] Int. Cl.[4] ..... A63C 15/00

[52] U.S. Cl. ..... 441/66; 441/131; 114/253

[58] Field of Search ..... 441/43, 65, 66, 67, 441/72, 81, 129, 130, 131; 114/345

[56] References Cited

U.S. PATENT DOCUMENTS

| | | | |
|---|---|---|---|
| 378,171 | 12/1888 | McCarthy | 114/311 |
| 526,126 | 9/1894 | Ericson | 114/234 |
| 1,190,743 | 7/1916 | Fageol | 441/131 |
| 1,764,852 | 6/1930 | Philips | 441/131 |
| 2,018,548 | 10/1935 | Currey | 441/66 |
| 2,075,374 | 3/1937 | Tucker | 441/131 |
| 2,173,963 | 9/1939 | Eubank | 441/131 |
| 3,074,084 | 1/1963 | Bisch | 441/131 |
| 3,080,584 | 3/1963 | Brown | 441/78 |
| 3,135,978 | 6/1964 | Grasmoen | 441/66 |
| 3,145,499 | 8/1964 | Yoakum | 43/44.91 |
| 3,435,471 | 4/1969 | Drennen, Jr. | 441/65 |
| 3,528,116 | 9/1970 | Fenar | 441/130 |
| 3,581,328 | 6/1971 | Smith | 441/67 |
| 3,748,672 | 7/1973 | Patrick et al. | 441/131 |
| 4,030,151 | 6/1977 | McKeen, Jr. | 114/364 |
| 4,160,299 | 7/1979 | Hilbern | 441/131 |
| 4,329,751 | 5/1982 | Cigognetti | 114/345 |
| 4,427,394 | 1/1984 | Felter | 441/66 |

*Primary Examiner*—Galen L. Barefoot
*Assistant Examiner*—Paul E. Salmon
*Attorney, Agent, or Firm*—Hill, Van Santen, Steadman & Simpson

[57] ABSTRACT

An improved water sports apparatus comprising an inflatable tube to which a seat portion with a number of straps can be attached by utilizing pins which are vulcanized to the tube and which pass through openings formed in the straps. The straps are joined by buckles around the tube and rings pass through openings provided in the pins so as to lock the straps to the inner tube. A pair of towing portions pass around the front of the tube and are provided with rings through which a tow rope and handle can be passed. The inner tube is inflated to extend out over the straps and a pair of handles are provided on a pair of the front straps for the user.

1 Claim, 5 Drawing Figures

WATER SPORTS APPARATUS

BACKGROUND OF THE INVENTION

1. Field of the Invention

The present invention comprises an improvement on my U.S. Pat. No. 4,427,394 which issued on Jan. 24, 1984 and comprises an improved water sport apparatus upon which a person can ride when being towed behind a boat.

2. Description of the Prior Art

My prior U.S. Pat. No. 4,427,394 and the fifteen references cited during the prosecution therein comprising U.S. Pat. Nos. 378,171, 526,126, 1,190,743, 1,764,852, 2,075,374, 2,173,063, 3,074,084, 3,080,584, 3,135,978, 3,145,400, 3,435,471, 3,528,116, 3,581,328, 4,030,151 and 4,160,299 disclose various arrangements of water sport devices of the prior art.

SUMMARY OF THE INVENTION

The present invention comprises a seat portion which can be mounted on an inner tube wherein the inner tube has a number of pins vulcanized to its outer periphery and straps on a seat portion are formed with openings that can be received over the pins and locked with locking rings which pass through openings through the pins. The straps can be locked by buckles to the inner tube and reinforcing portions are formed under the straps to distribute the forces on the inner tube. After the straps have been attached, the inner tube is inflated so that portions of the inner tube extend out beyond the straps and a pair of front towing portions extend over the top and bottom of the inner tube and terminate in rings which are separated from each other. A towing rope with a handle passes through the lower towing ring and then through the upper towing ring to attach the device to the tow rope. A pair of handles are attached to the front straps adjacent the towing portions for the user and the seat is provided with openings covered with webbing so that water will pass out of the seat.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
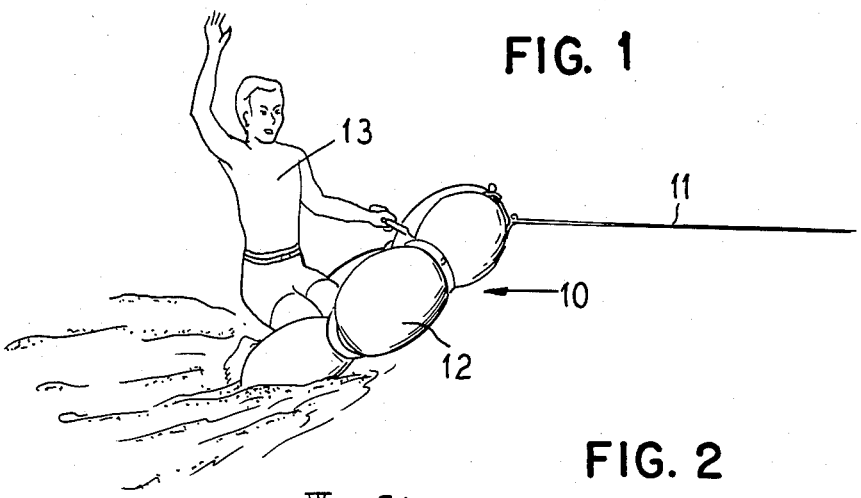
FIG. 1 is a side elevational view of the invention in use.

FIG. 1 illustrates a user 13 seated on the water sport device of the invention 10 which is mounted on an inner tube and which is towed by tow rope 11 through the water by a tow boat not shown.

Figure 2:
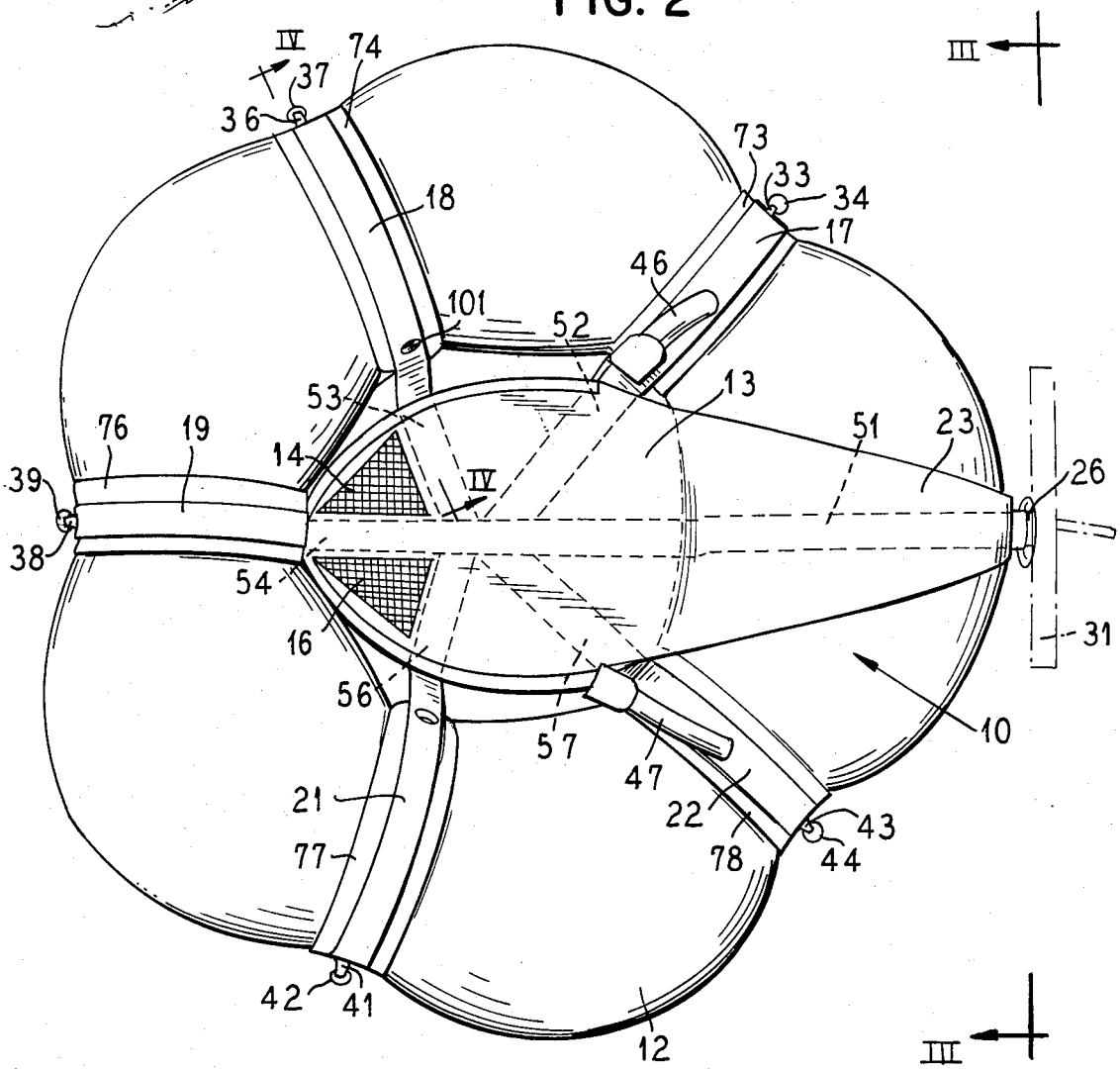
FIG. 2 is a top plan view of the invention.
Figure 5:
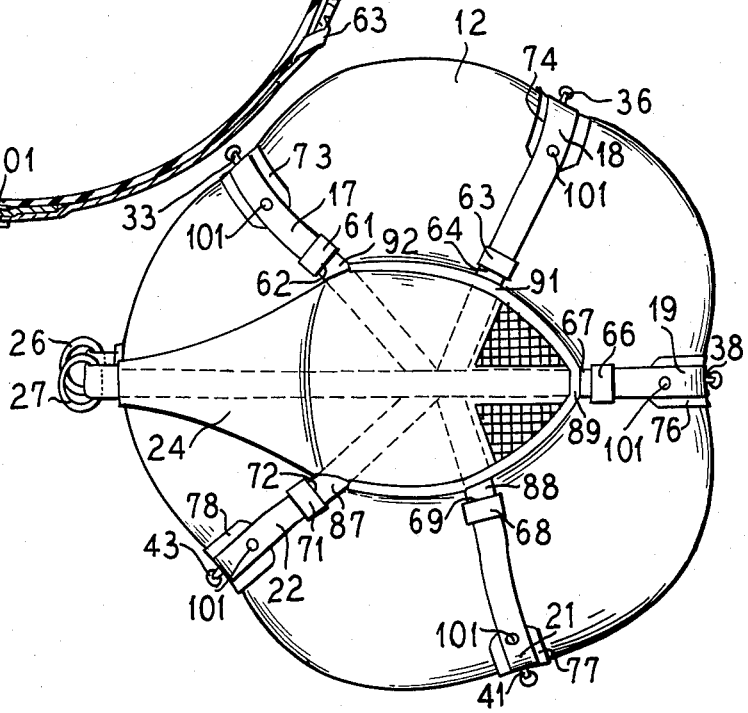
FIG. 5 is a bottom view of the invention.

As shown in FIG. 2 the attachment 10 comprises a seat portion 13 which fits within the center of the inner tube 12 and which is provided with upper straps 17, 18, 19, 21 and 22 which extend from the seat portion 13 out around the inner tube as shown. As shown in FIG. 5 the seat also has lower straps 87, 88, 89, 91 and 92 which extend to the straps 17, 18, 19, 21 and 22 and are attached thereto by buckles 61, 62, 63, 64, 66, 67, 68, 69 and 71 and 72. Reinforcing pads 73, 74, 76, 77 and 78 are attached to the straps 17, 18, 19, 21 and 22 and lie between the straps and the inner tube 12. The reinforcing pads 73, 74, 76, 77 and 78 are connected to the straps 17, 18, 19, 21 and 22 by rings 101 which lock them together as shown in FIGS. 2 and 5.

The straps 17, 18, 19, 21 and 22 have portions 52, 53, 54, 56, 57 which extend and join at the center of the seat portion 13 so as to reinforce the seat portion.

Five pins 33, 36, 38, 41 and 43 are vulcanized to the outer periphery of the tube 12 at spaced intervals and pass through aligned openings 102, formed in the straps 17, 18, 19, 21 and 22 and their reinforcing pads 73, 74, 76, 77 and 78. Reinforcing grommets 103 extend through the reinforcing pads 73, 74, 76, 77 and 78 and the straps 17, 18, 19, 21 and 22 and the pins extend through grommets 103. The pins 33, 36, 38, 41 and 43 are formed with openings through which split 0-rings 34, 37, 39, 42 and 44 can be inserted after the pins are extended through the reinforcing pads and straps so as to lock the straps and reinforcing pads to the tube 12.

Figure 3:
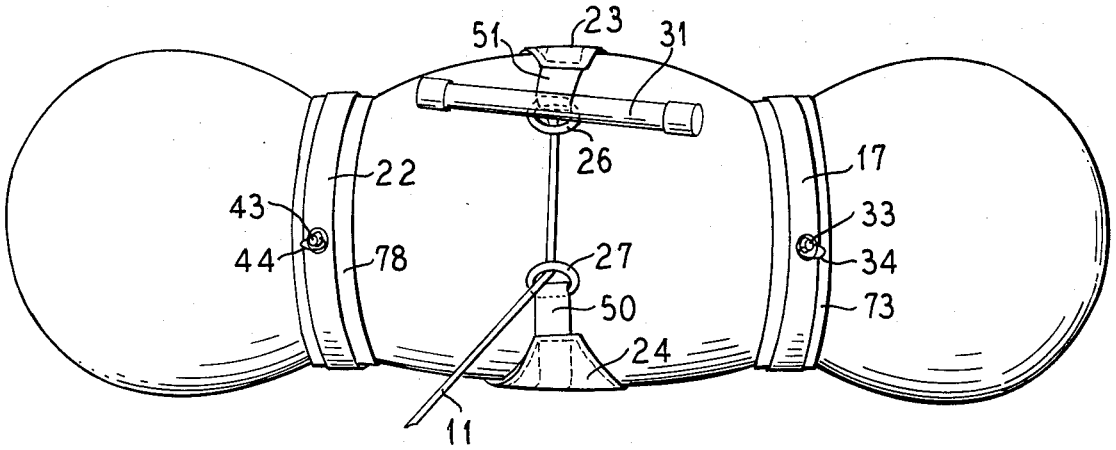
FIG. 3 is a front view of the invention.
Figure 4:
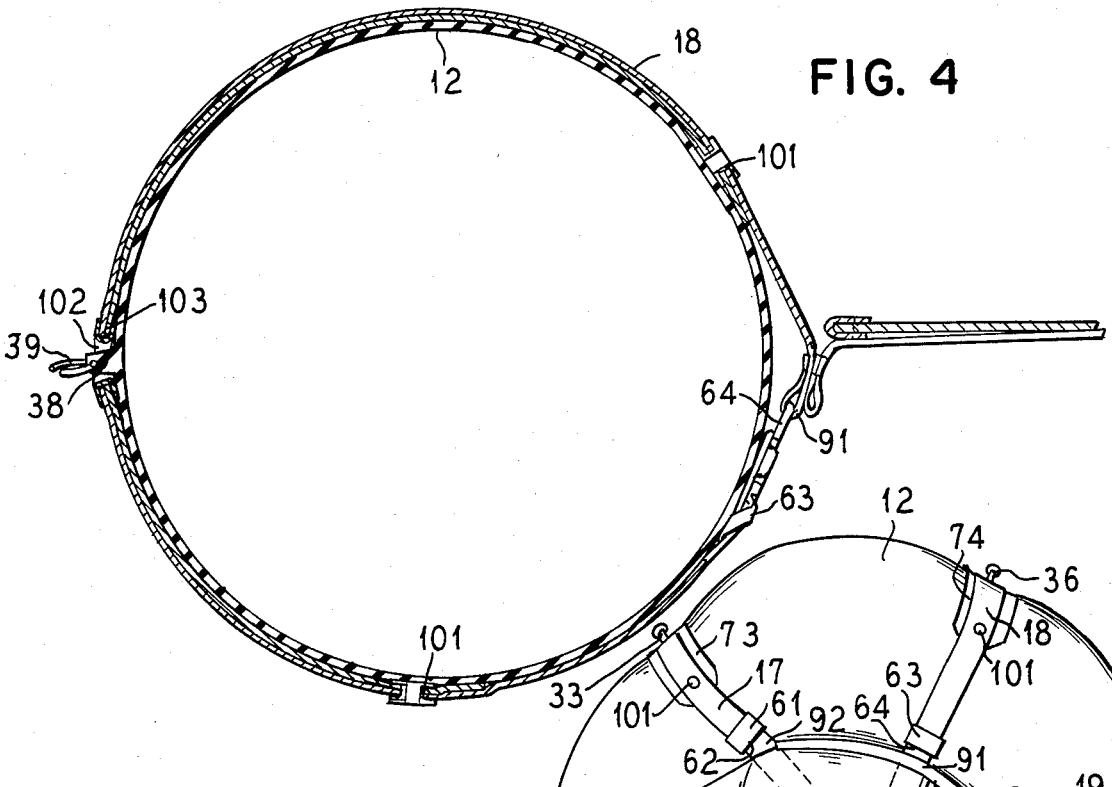
FIG. 4 is a sectional view taken on line IV—IV in FIG. 2.

A pair of extending towing portions 23 and 24 are attached to the seat portion 13 and the upper towing portion 23 extends from the seat portion over the upper portion of the tube 12 and the lower towing portion 24 extends around the lower portion of the tube as shown. The towing portions terminate in rings 26 and 27 as shown in FIGS. 2 and 3. Straps 51 and 50 extend from seat portion 13 through portions 23 and 24.

After the straps 17, 18, 19, 21 and 22 have been attached to the inner tube and to the lower straps 87, 88, 89, 91 and 92 by the buckles 61, 62, 63, 64, 66, 67, 68, 69 and 71, 72 the inner tube is inflated so that the portions between the straps 17, 18, 19, 21 and 22 will bulge outwardly and such that the rings 26 and 27 will be spaced apart as, for example, 6 to 8 inches due to the inflation and bulge of the inner tube 12. The tow rope 11 has a handle 31 which is inserted through the lower ring 27 and then through the upper ring 26.

The seat 13 is provided with drain portions 14 and 16 which are formed of gauze so that water in the seat will drain out of the seat. Instead of gauze covered openings the openings may be opened if desired.

Handles 46 and 47 are attached to the straps 17 and 22 as illustrated for the user.

In operation, after the seat has been attached to the tube 12 and the tube has been inflated so that the tube bulges out over the straps 17, 18, 19, 21 and 22 as illustrated in FIG. 2, the user kneels or lays on the rear of the tube as the boat starts up and the user pulls back on the handles 46 and 47 so as to lift the front edge of the tube 12 as illustrated in FIG. 1 so that water will not build up in the front of the tube. The handles 46 and 47 allow the user to steer the tube and device.

The buckles 61, 62, 63, 64, 66, 67, 68, 69, 71, 72 may be of the quick release type to allow easy assembly. The tube 12 has a conventional inflation valve to allow air to be inserted or removed from the tube as desired.

The openings 14 and 16 allow the evacuation of water that might become trapped in the tube during operation.

Although the invention has been described as a device to be towed, it is to be understood that the invention can be used as a raft on water or may be used on snow as a sled.

Although the invention has been described with respect to certain preferred embodiments, it is not to be so limited as changes and modifications may be made therein which are within the full intended scope as defined by the appended claims.

I claim as my invention:

1. A water sport device comprising an inner tube which can be inflated and to which a plurality of holding pins are attached to its outer periphery, a seat portion of plastic material with a plurality of upper and lower straps extending therefrom, locking means attached to said upper and lower straps so that matching ones of said upper and lower straps can be connected around said inner tube by said locking means, said plaurlity of said upper and lower straps formed with openings that fit over said holding pins attached to said inner tube, transverse openings formed through said holding pins, locking split rings receivable in said transverse openings of said holdings pins so as to lock said straps to said inner tube, and a pair of towing portions extending from said seat portion and said inner tube so that they can be attached to a tow rope including tow rings attached to the ends of said pair of towing portions for receiving a tow rope therethrough, including at least one handle attached to one of said plurality of straps, wherein said inner tube is inflated after said plurality of straps are connected together to cause said inner tube to bulge out between said straps, and wherein there are five upper straps and five lower straps.

* * * * *